United States Patent [19]

Yamaguchi et al.

[11] 4,256,355

[45] Mar. 17, 1981

[54] LOCKING AND UNLOCKING DEVICE FOR MANUALLY MOVABLE WHEELED STORAGE RACK OR THE LIKE

[75] Inventors: Tsuneo Yamaguchi; Kiyoshi Harashima, both of Tokyo, Japan

[73] Assignee: Elecompack Company Ltd., Tokyo, Japan

[21] Appl. No.: 53,976

[22] Filed: Jul. 2, 1979

Related U.S. Application Data

[63] Continuation of Ser. No. 812,634, Jul. 5, 1977, abandoned.

[30] Foreign Application Priority Data

Dec. 22, 1976 [JP] Japan ..... 51-172057
Dec. 24, 1976 [JP] Japan ..... 51-173323

[51] Int. Cl.[3] ..... A47B 53/00; F16D 63/00; G05G 1/00

[52] U.S. Cl. ..... 312/198; 312/200; 188/82.2; 74/577 M; 104/287

[58] Field of Search ..... 74/575, 576, 577 R, 74/577 S, 577 M, 578; 105/29 R, 30, 31; 188/82.1, 82.2, 82.3, 82.34, 82.4, 82.7; 312/200, 198, 201, 202; 104/147, 165, 88

[56] References Cited

U.S. PATENT DOCUMENTS

| | | | |
|---|---|---|---|
| 1,555,724 | 9/1925 | Tuppan | 188/82.3 X |
| 1,595,557 | 8/1926 | Mamiya | 74/551.4 |
| 3,640,595 | 2/1972 | Staller | 312/200 |
| 3,829,189 | 8/1974 | Staller | 312/200 |
| 3,856,119 | 12/1974 | Harrington | 188/82.3 |
| 3,957,323 | 5/1976 | Tucker | 312/200 |
| 4,017,131 | 4/1977 | Camenisch | 312/200 |

FOREIGN PATENT DOCUMENTS

| | | | |
|---|---|---|---|
| 123583 | 12/1900 | Fed. Rep. of Germany | 188/82.2 |
| 395413 | 2/1909 | France | 188/82.2 |

*Primary Examiner*—Samuel Scott
*Assistant Examiner*—G. Anderson
*Attorney, Agent, or Firm*—Richard L. Cannaday; William J. Ungvarsky; Francis C. Hand

[57] ABSTRACT

A locking and unlocking device for a manually movable wheeled storage rack or the like is disclosed wherein a toothed locking wheel is operatively connected to wheels of a storage rack, and a pair of locking and unlocking leverages each including a catch are disposed symmetrically about the axis of the locking wheel so that the catches may selectively engage with or disengage from the teeth of the locking wheel by the operation of operating knobs exterior of the storage rack. When one of the catches is made into engagement with the toothed locking wheel while the other is out of engagement therefrom, the rotation in one direction of the locking wheel is locked while the rotation in the other direction is unlocked, and vice versa.

5 Claims, 8 Drawing Figures

LOCKING AND UNLOCKING DEVICE FOR MANUALLY MOVABLE WHEELED STORAGE RACK OR THE LIKE

This is a continuation of application Ser. No. 812,634 filed July 5, 1977, now abandoned .

The present invention relates to a device for temporarily locking the movement of a manually movable wheeled storage rack or the like.

There have been devised and demonstrated various types of manually movable storage rack systems wherein a plurality of wheeled storage racks ride on a pair of spaced guide rails on the floor so that they may be moved directly by an operator or through a manually operable mechanical reduction gear or the like. Various types of locking and unlocking device for use in such movable wheeled storage racks have been also devised and demonstrated so that the closing of an access passageway between the adjacent storage racks due to the careless operation of an operator may be prevented so as to protect another operator or articles in the access passageway. The locking and unlocking device of the type described must be incorporated especially in the movable wheeled storage rack which is movable by the rotation of a rotary handwheel of the mechanical reduction gear or the like drivingly coupled to drive wheels of the storage rack in order to ensure the safeguarded operation of movable wheeled storage racks.

The prior art locking and unlocking devices lock the movable wheeled storage racks in such a way that the movement in either direction thereof may not be permitted. This means that the movable storage rack can be locked only after it has been moved to and completely stopped at a desired position. In other words, the sequence for locking the movable wheeled storage rack has been predetermined. As a result, the smooth and efficient movement of the wheeled storage racks has been adversely affected and the storage racks have very frequently remained unlocked due to the negligence of the operators.

With the movable wheeled storage racks each having the locking and unlocking device of the type described, the adjacent storage racks facing the access passageway must be locked before the entry into the access passageway is permitted. When this access passageway is to be closed, one of the storage racks facing the passageway must be manually unlocked and the moved toward the other storage rack. Thus the storage racks remain unlocked unless they are manually and individually unlocked, and therefore when a plurality of wheeled storage racks must be moved simultaneously, the operator must visually check each of the storage racks whether it is locked or unlocked, and must unlock the locked storage rack so that the operation of moving the wheeled storage racks consumes considerable time.

One of the objects of the present invention is therefore to provide a locking and unlocking device for a movable wheeled storage rack or the like which can positively lock the movement in one direction of said storage rack or the like while permitting the movement thereof in the other direction.

Another object of the present invention is to provide a locking and unlocking device of the type described which can positively lock the storage rack or the like prior to, during or after the movement thereof so that the wheeled storage rack cannot move in the direction in which an opening or opened access passageway is closed, whereby the operation may be safeguarded and improved in efficiency. When the wheeled storage rack or the like is locked so as not to move in the direction opposite to the direction of movement, the rebounding of the wheeled storage rack or the like from the collision against the adjacent wheeled storage rack or the like or the wall may be prevented.

A further object of the present invention is to provide a locking and unlocking device of the type described above which may be automatically brought to the unlocking position when the adjacent wheeled storage racks are adjoined so that the adjoined storage racks always remain unlocked and consequently the operator may be free from the cumbersome unlocking operation.

Same reference numerals are used to designate similar parts throughout the figures.

First Embodiment, FIGS. 1 through 5

Figure 1:
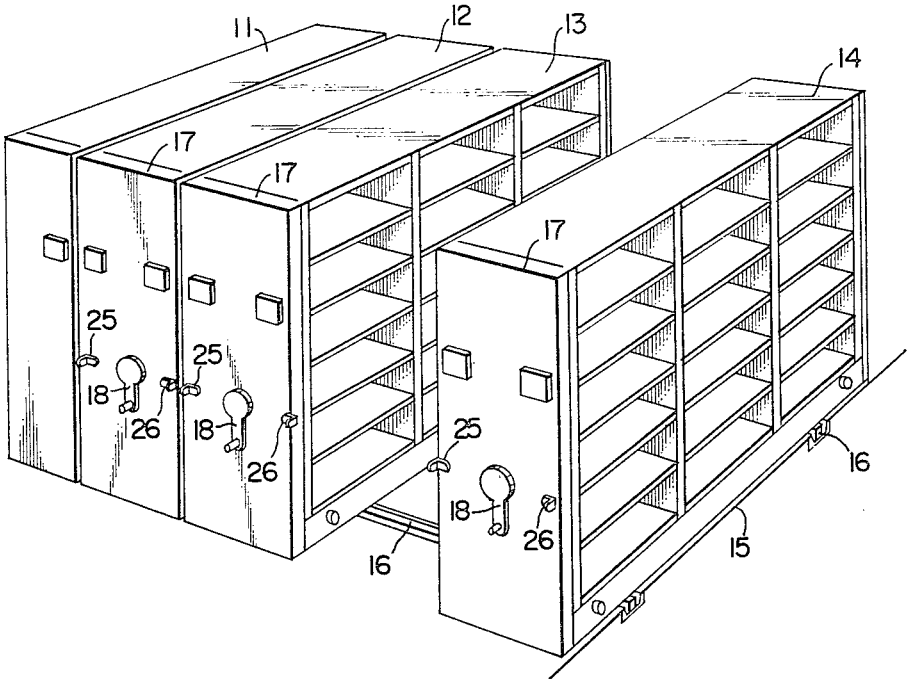
FIG. 1 is a perspective view of manually movable wheeled storage racks each incorporating a first embodiment of a locking and unlocking device in accordance with the present invention.
Figure 2:
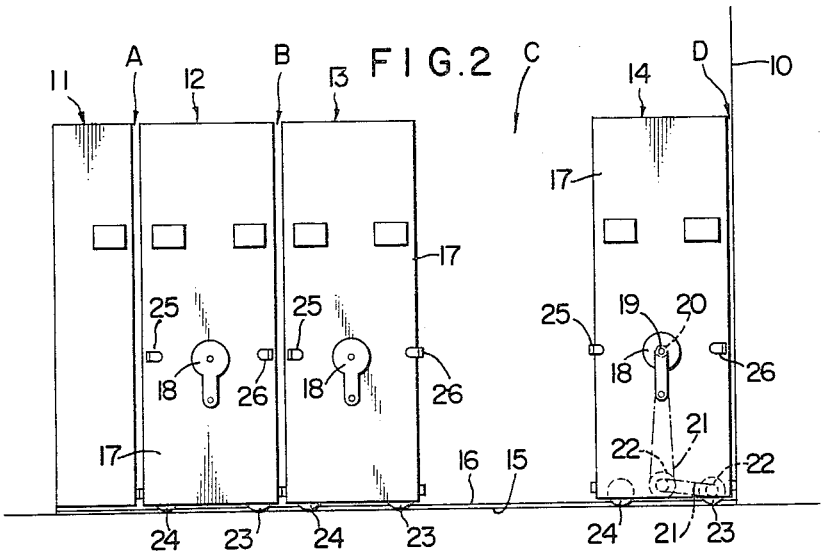
FIG. 2 is a side view thereof.

In both the first and second embodiments, the present invention will be described as being applied to manually movable wheeled storage racks. First referring to FIGS. 1 and 2, three movable storage racks 12, 13 and 14 each consisting of a top, a bottom, opposed end plates 17 and a number of racks are movable along guide rails 16 on the floor 15 in a warehouse or the like between a wall 10 and a stationary storage rack 11, the spaces between the adjacent storage racks being indicated by A, B, C and D as shown in FIG. 2.

Each of the movable storage racks 12, 13 and 14 is movable in either direction when an operator rotates a handwheel 18 on the end plate 17. That is, the handwheel 18 is connected to a rotary shaft 19 carrying a first or upper sprocket wheel 20 which in turn is drivingly coupled with an endless chain 21 to a second or lower sprocket wheel 22 which in turn in drivingly coupled to a drive wheel 23 of the movable storage rack which also has driven wheels 24. Since the driving mechanism described above is well known in the art and forms no part of the present invention, no attempt will be made to describe this particular mechanism in this specification. Each of the movable storage racks 12, 13 and 14 is further provided with locking and unlocking knobs 25 and 26 to be described in more detail hereinafter.

Next referring to FIGS. 3, 4 and 5, a novel movable wheeled storage racks locking and unlocking device in accordance with the present invention will be described. As best shown in FIG. 4, it includes a pair of widthwise spaced supporting plates 31 and 32 which may be constructed or joined as a unitary structure and which is securely joined to the interior surface of the end plate 17. (In this specification, the term "widthwise" is used to refer to the direction normal to the end plate 17 or guide rails 16 while the term "depthwise" to refer to the direction in parallel with the end plate 17 or guide rails 16.) The rotary shaft 19 carrying the handwheel 18 at one end thereof and the first or upper sprocket wheel 20 intermediate at ends thereof is rotatably supported by bearings 33 and 34 which in turn are securely attached to the supporting plates 32 and 31, respectively.

Figure 4:
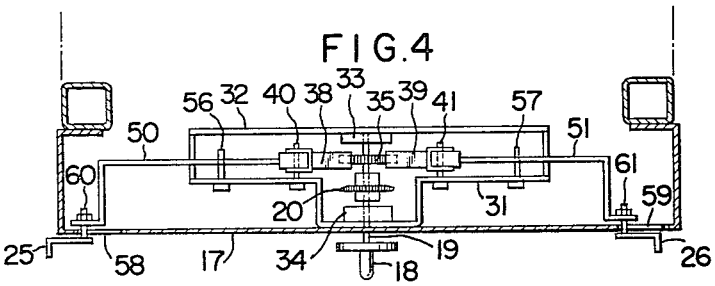
FIG. 4 is a top view thereof.
Figure 5:
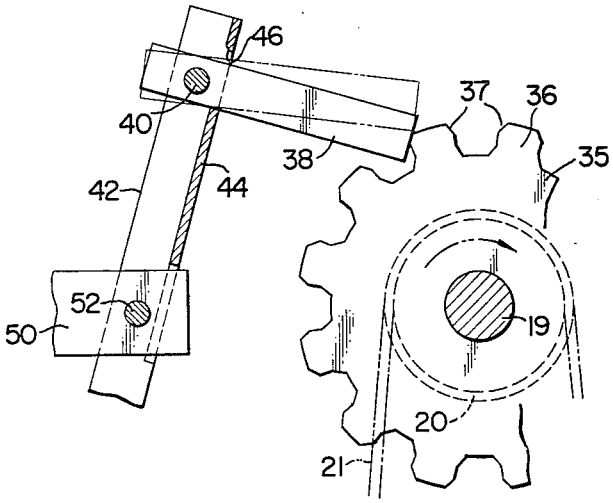
FIG. 5 is a view, on enlarged scale, illustrating the engagement between a toothed locking wheel and a catch member.

A toothed locking wheel 35 which is carried by the rotary shaft 19 for unitary rotation therewith has a plurality of teeth 36 each having its face of the tooth beveled or otherwise inclined as indicated by 37 in FIG. 5. The components to be described below which cooperate with the locking wheel 35 for locking or unlocking the movable storage rack are symmetrically arranged as two sets about the axis of the rotary shaft 19 or locking wheel 35 so that a description of only one set will be suffice. A catch member 38 or 39 is arranged for engagement with the teeth 36 of the locking wheel 35 for locking the rotation thereof in the counterclockwise or clockwise direction while permitting the rotation in the clockwise or counterclockwise direction as will be described in more detail hereinafter. The catch member 38 (or 39) is swingably carried by i.e. pivotally mounted on, a pivot pin 40 (or 41) which in turn is rigidly secured to the supporting plate 31 as best shown in FIG. 4. One end of a channel-shaped lever member 42 (or 43) U-shaped in cross section as best shown in FIG. 4 is also pivoted to the pivot pin 40 (or 41) while the other end of the lever member 42 (or 43) is connected to one end of a compression spring 48 (or 49) whose the other end is securely attached to the supporting plate 31 or 32 so that when a horizontal actuating or operating member 50 (or 51) to be described below in detail is caused to slide in either direction, the lever member 42 (or 43) may be snapped into and securely held in the locking or unlocking position. The catch member 38 (or 39) is extended through an elongated slot 46 (or 47) formed through the bottom or base 44 (or 45) of the channel-shaped lever member 42 (or 43), the size of the elongated slot 46 (or 47) being so selected that the swinging motion of the catch member 38 (or 39) may be freely permitted for the purpose to be described hereinafter. The catch member 38 (39) and lever member 42 (43) constitute an engaging means for the wheel 35.

The operating member 50 (or 51) is roughly L-shaped and has its one end pivoted with a pivot pin 52 (or 53) to the lever member 42 (or 43) at a point slightly downwardly offset from the center thereof and its other end terminated into a flange extended depthwise or in parallel with the end plate 17 as best shown in FIG. 4. The operating member 50 (or 51) is formed with a horizontally elongated slot 54 (or 55) as best shown in FIG. 3, and a stopper pin 56 (or 57) securely fixed to the supporting plate 31 is slidably fitted into this elongated slot for limiting the horizontal stroke of the operating member 50. The other end or flange portion of the operating member 50 (or 51) is rigidly connected with the L-shaped operating knob 25 (or 26) through a connecting member 60 (or 61) extended widthwise through a horizontally elongated slot 58 (or 59) formed through the end plate 17. Thus, an operator may grip the operating knob 25 (or 26) to shift the operating member 50 (or 51) horizontally in either direction, the stroke of the operating member 50 (or 51) being dependent upon the horizontal or depthwise dimension of the elongated slot 54 (or 55).

Figure 3:
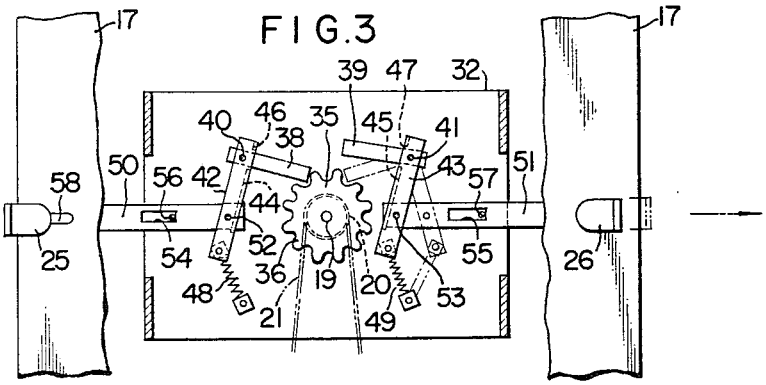
FIG. 3 is a front view of the first embodiment of the present invention with a supporting plate removed.

When the operating knob 25 is shifted to the left position in FIGS. 3 and 4, the rotation of the locking wheel 35 in the counterclockwise direction is locked, and the left position of the operating knob 26 in FIGS. 3 and 4 is the unlocked position. It is apparent that the left and right operating knobs 25 and 26 may be shifted between the locking and unlocking positions independently of each other. Furthermore when the adjacent movable storage racks are spaced apart from each other by a minimum distance, the operator may grip with his one hand both the operating knob 25 of one movable storage rack and the operating knob 26 of the other movable storage rack so as to move them toward to each other, thereby locking both the storage racks at one action.

Referring back to FIGS. 1 and 2, the movable storage racks 13 and 14 are spaced apart from each other to provide the passageway C to permit the access thereto. The operating knob 26 of the movable storage rack 13 as well as the operating knob 25 of the movable storage rack 14 are held in the locked position to that the movement of the storage rack 13 to the right and the movement of the storage rack 14 to the left are both locked. That is, when the operator grips the operating knob 25 and shifts it to the left, the operating member 50 is caused to be shifted to the left so that the lever member 42 is caused to rotate in the clockwise direction as shown in FIG. 3. Consequently, the catch member 38 engages with the teeth 36 of the locking wheel 35 so that the rotation in the counterclockwise direction of the locking wheel 35 is locked and accordingly the rotation of the handwheel 18 in the counterclockwise direction for moving the storage rack 14 to the left is positively prevented. The locking operation by the operating knob 26 of the storage rack 13 is substantially similar to that described above except that the associated components 51, 43 and 39 are displaced in the opposite direction.

Next the mode of operation for unlocking the movement of the storage rack 13 to the right will be described. The operator grips the right operating knob 26 and moves it to the left to cause the operating member 51 to shift to the left so that the lever member 43 is caused to rotate in the clockwise direction. Consequently, the catch member 39 is caused to move away and disengage from the teeth 36 of the locking wheel 35. Thus, the operator can rotate the handwheel 18 in the clockwise direction to move the storage rack 13 to the right.

When the handwheel 18 is rotated in the clockwise direction so that the locking wheel 35 is rotated in the same direction as indicated by the arrow in FIG. 5, the leading end of the catch member 38 is raised by the tooth 36 as indicated by the broken lines in FIG. 5 to ride over this tooth and then drops into the next tooth space. For this purpose, the elongated slot 46 at the bottom of the channel-shaped lever member 42 must be so sized as to permit the intermittent swinging motion, i.e. pivoting of the catch member 38. Same is true for the elongated slot 47 formed through the bottom of the right channel-shaped lever member 43.

As described above, the locking device in accordance with the present invention includes the toothed locking wheel operatively coupled to both the handwheel 18 and the drive wheel 23 and adapted to be locked from rotating in both or either direction by the left and right catch members 38 and 39 operable by the left and right operating knobs 25 and 26. More particularly, each of the movable storage racks can be so locked that the movement in one direction is positively prevented while the movement in the other direction is free.

Referring back again to FIGS. 1 and 2, the mode of operation for providing the access passageway B between the storage racks 12 and 13 will be described. As described above, the movement of the adjacent storage racks 13 and 14 toward each other for eliminating or closing the access passageway C therebetween is locked. Therefore the first step is to bring the operating knob 26 to the unlocked position for permitting the movement of the storage rack 13 to the right. Thereafter, the operator must bring the operating knob 25 of the storage rack 13 and the right operating knob 26 of the storage rack 12 to their locked positions so as to prevent the movement of the storage rack 13 to the left and the movement of the storage rack 12 to the right. Next the operator rotates the handwheel 18 of the storage rack 13 in the clockwise direction so as to move the storage rack 13 to the right away from the storage rack 12, thereby providing the access passageway B between them. Once the access passageway has been provided, the movement of the storage rack 13 to the left and the movement of the storage rack 12 to the right can be positively locked.

So far the operating knob 25 of the storage rack 13 and the operating knob 26 of the storage rack 12 have been described as being brought to the locking positions at the same time prior to the movement of the storage rack 13 to the right, but these operating knobs 25 and 26 may be brought to their locking positions during or after the movement of the storage rack 13 to the right.

In addition to the movement of a single storage rack, a plurality of storage racks may be moved simultaneously. That is, the operating knobs of the storage racks are brought to the unlocked positions so that the movement of these storage racks to the direction in which the existing access passageway is closed, and thereafter the handwheel of the storage rack remotest from the access passageway is rotated so that all the storage racks may be simultaneously moved toward the access passageway.

In summary, according to the present invention each of the movable storage racks can be so locked that its movement in one direction can be positively locked while the movement in the other direction may be free. Locking operation may be effected at any time; that is, prior to, during and after the movement of the storage rack so that the operator may move the storage rack or racks in a safeguarded manner without being disturbed by a predetermined locking sequence. In addition, the operating knobs of the adjacent or adjoint storage racks are so positioned that they may be gripped and brought to their locking positions by one action in a simple and positive manner. Furthermore when the operating knob or knobs are brought to their locking positions during or prior to their movement, the rebounding of the storage rack from the collision against the adjacent storage rack or wall may be positively prevented.

Figure 6:
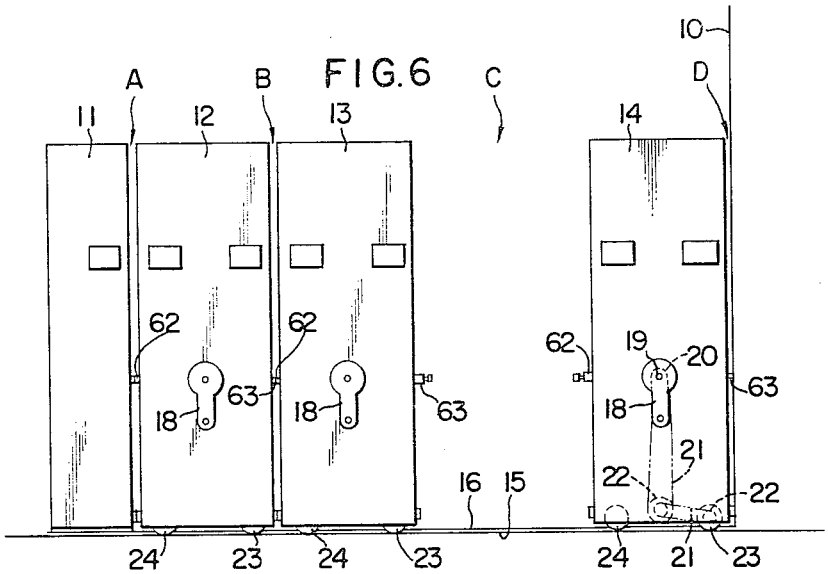
FIG. 6 is a side view of manually movable wheeled storage racks each incorporating a second embodiment of a locking and unlocking device in accordance with the present invention.
Figure 7:
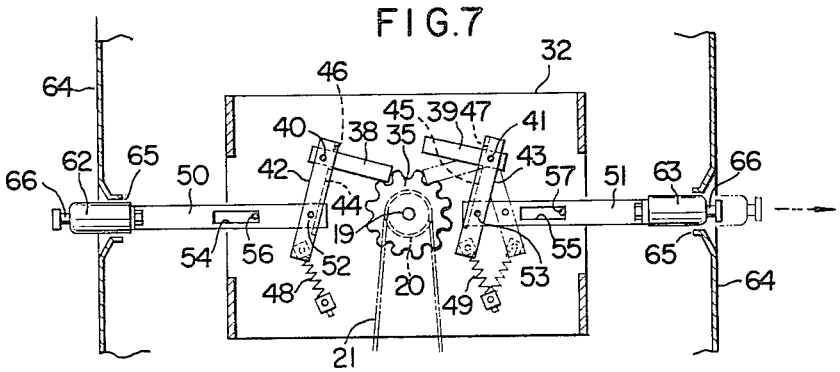
FIG. 7 is a front view of the second embodiment with a supporting plate removed.
Figure 8:
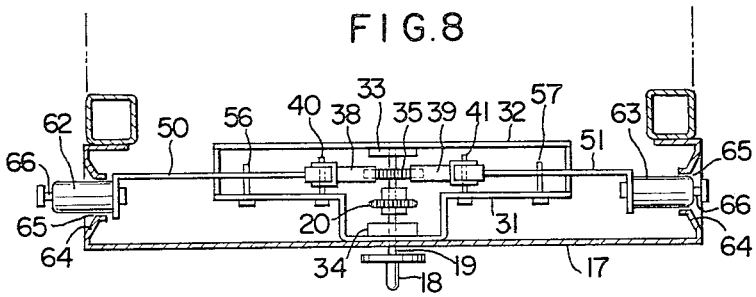
FIG. 8 is a top view thereof.

Second Embodiment, FIGS. 6 through 8

The second embodiment shown in FIGS. 6, 7 and 8 is substantially similar in construction to the first embodiment except the arrangement of an operating knob and its associated parts so that the following description is limited only to these parts. Instead of the operating knob 25 (or 26) of the first embodiment, a cylindrical sliding member 62 (or 63) has its one end securely attached to the widthwise extending arm of the operating member 50 (or 51) and is extended depthwise or in parallel with the end plate 17 beyond a side face or plate 64 through an opening 65 formed therethrough. An operating knob 66 is securely attached to the other or outer end of the sliding member 62 (or 63), and may be pulled into the locking position or pushed into the unlocking position. The overall length of the sliding member 62 (or 63) and its operating knob 66 is so selected that when the sliding member 62 (or 63) is pushed a predetermined distance by the corresponding sliding member 63 (or 62) of the adjacent storage rack the sliding member 62 (or 63) may be automatically snapped into the unlocking position under the force of the compression spring 48 (or 49). Furthermore the sliding member 62 (or 63) may be manually pushed into the unlocking position.

Next the mode of operation of the second embodiment with the above construction for providing the access passageway between the movable storage rack 12 and 13 will be described. In FIG. 6 it is assumed that the storage racks 13 and 14 are initially so locked as to prevent the closure of the access passageway therebetween. Therefore the first step is to manually push the sliding member 63 of the storage rack 13 into the unlocking position to permit the movement of the storage rack 13 to the right. Thereafter the handwheel 18 is rotated in the clockwise direction to cause the storage rack 13 to move to the right. The storage rack 13 approaches the storage rack 14 with the sliding member 63 of the storage rack 13 striking against the sliding member 62 of the storage rack 14 and pushing it into the unlocking position in the manner described above. Thereafter the operator pulls the right sliding member 63 of the storage rack 12 and the left sliding member 62 of the storage rack 13 to lock the movement to the right of the storage rack 12 and the movement to the left of the storage rack 13 so that the closing of the newly provided access passageway between them may be positively prevented.

To provide the access passageway C or D after the access passageway B between the storage racks 12 and 13 has been provided in the manner described above, only the left sliding member 62 of the storage rack 13 is pushed into the unlocking position while the sliding member 63 of the storage rack 12 is left untouched. Thereafter the handwheel 18 of the storage rack 13 is rotated in the counterclockwise direction to move the storage rack 13 to the left. As the storage rack 13 approaches the storage rack 12 closing the access passageway therebetween, the left sliding member 62 of the storage rack 13 strikes against the right sliding member 63 of the storage rack 12 to automatically push it into the unlocking position. Therefore the adjoining storage racks are automatically unlocked.

So far the sliding members have been described as being positioned so as to make contact with the adjacent one, but they may be so positioned as to make contact with the adjacent rack at any suitable point thereof. In addition, instead of the horizontally movable sliding member 62 or 63, a lever may be used which is so pivoted to the operating member 50 or 51 and the storage rack that the lever in the locking position may be extended out of the storage rack but may be retracted therein when brought to the unlocking position. Alternatively, such linkage may be operatively connected to the sliding member 62 or 63.

In summary according to the second embodiment of the present invention the sliding member which is extended out of the storage rack in the locking position is pushed into the storage rack in the unlocking position when the adjacent storage rack are adjoined to each other. Thus, the adjoined storage racks are unlocked so that one or more storage racks may be moved when the storage rack facing the existing access passageway is unlocked. Therefore opposed to the prior art manually wheeled movable rack system incorporating manual locking and unlocking devices, it is not required to find out the locked storage rack or racks among the adjoined storage racks and to unlock them. Furthermore the sliding member 62 or 63 is extended out of the storage rack when it is held in the locked position so that the operator in the access passageway can easily detect whether the storage racks on both sides of the access passageway are locked or not.

In both the first and second embodiments the storage racks are moved by the rotation of the crank type handle 18 so that the locking wheel 35 has been described as being mounted on the rotary shaft 19, but the locking device may be associated with the drive wheels 23 instead of the power mechanism; that is, the rotary shaft 19. More particularly, with a storage rack of the type which is moved directly by an operator without the use of a manual drive mechanism, the locking device of the present invention may be associated with the wheels of the storage rack so that the wheels themselves may be locked and unlocked.

What is claimed is:

1. In combination with at least one movable storage rack having a driving mechanism for moving said rack in opposite directions;

a locking and unlocking mechanism for said rack comprising a rotatable toothed locking wheel drivingly connected with said driving mechanism;

a first engaging means on one side of said wheel including a first catch member pivotally mounted at one end about a first axis to move under gravity into a first position in engagement with said wheel to prevent rotation of said wheel in one direction while permitting rotation of said wheel in an opposite direction and a second position spaced from said wheel, and a first lever member pivotally mounted about said axis and having a slot with said first catch member passing therethrough;

second engaging means on an opposite side of said wheel including a second catch member pivotally mounted at one end about a second axis to move under gravity into a first position in engagement with said wheel to prevent rotation of said wheel in said opposite direction while permitting rotation of said wheel in said one direction and a second position spaced from said wheel, and a second lever member pivotally mounted about said second axis and having a slot with said second catch member passing therethrough;

a first operating member connected to said first lever member and being slidably mounted on said rack in a horizontal plane for movement between a locking position and an unlocking to pivot said first lever member about said first axis to cause said first catch member to pivot between said first and second positions thereof, said operating member having a terminal end exposed to the exterior of said rack; and a second operating member connected to said second lever member and being slidably mounted on said rack in a horizontal plane for movement between a locking position and an unlocking position to pivot said second lever member about said second axis to cause said second catch member to pivot between said first and second positions thereof, said second operating member having a terminal end exposed to the exterior of said rack whereby as each of said operating members is slid into its locking position, said rack is locked against movement in a respective one of said opposite directions thereof.

2. The combination as set forth in claim 1 which includes a plurality of said racks, each said rack having a locking and unlocking mechanism thereon, and a plurality of guide rails having said racks mounted thereon.

3. The combination as set forth in claim 2 wherein each terminal end of a respective operating member projects from a respective rack towards an adjacent rack whereby upon movement of said adjacent racks together along said rails the facing operating members of said adjacent racks contact an opposite rack and move into said unlocking positions thereof.

4. The combination as set forth in claim 3 wherein said operating members of adjacent racks are disposed in facing relation to each other.

5. The combination as set forth in claim 1 wherein said slot of each lever member is sized to permit intermittent pivoting of said respective catch member therein.

* * * * *